United States Patent [19]

Hillman

[11] 4,425,524

[45] Jan. 10, 1984

[54] PIEZOELECTRIC SWITCH USING PIEZOCERAMIC BENDING ELEMENTS, AND IN PARTICULAR A RELAY UTILIZING SUCH ELEMENTS

[75] Inventor: Garth D. Hillman, Nashville, Tenn.

[73] Assignee: Northern Telecom Inc., Nashville, Tenn.

[21] Appl. No.: 412,229

[22] Filed: Aug. 27, 1982

Related U.S. Application Data

[63] Continuation of Ser. No. 167,002, Jul. 9, 1980, abandoned.

[51] Int. Cl.[3] ..... H01H 57/00

[52] U.S. Cl. ..... 310/332; 200/181

[58] Field of Search ..... 200/181, 308; 310/332; 335/17; 337/376; 340/644

[56] References Cited

U.S. PATENT DOCUMENTS 2,330,461 9/1943 Wantz ..... 200/308

3,507,054 4/1970 Janke ..... 200/181

3,777,093 12/1973 Sterns et al. ..... 200/181

FOREIGN PATENT DOCUMENTS 273157 7/1964 Australia ..... 200/181

*Primary Examiner*—J. D. Miller

*Assistant Examiner*—D. L. Rebsch

*Attorney, Agent, or Firm*—Schwartz, Jeffery, Schwaab, Mack, Blumenthal & Koch

[57] ABSTRACT

A piezoceramic device has two layers of piezoceramic material bonded together, the layers polarized in opposite directions. The device is used to detect, and indicate, a change of voltage between two conductors and specifically is used between the tip and ring lines of a telephone line having more than one extension, to give a line status indication. A visual, yet non-electrical, readout of one polarity is provided when the bending piezoelectric element moves into a window in the housing wall.

4 Claims, 4 Drawing Figures

PIEZOELECTRIC SWITCH USING PIEZOCERAMIC BENDING ELEMENTS, AND IN PARTICULAR A RELAY UTILIZING SUCH ELEMENTS

This is a continuation of application Ser. No. 167,002, filed July 9, 1980 now abandoned.

This invention relates to a piezoelectric switch using piezoelectric bending elements, and in particular relates to such elements providing an electric relay switch function as an alternative to a magnetic relay function. A specific example of such a device is as a line status indicator such as in a single telephone line having more than one extension. Various forms of relay actuated switches exist but these are usually current sensitive and thus use power. This, in turn generally requires a separate, additional, power source other than the power source being switched. Thus for a telephone line, a separate power source, other than that of the telephone line, is usually required.

The present invention provides an alternative to the magnetic relay, being an electric relay which does not consume power. The application uses the feature of bending of a piezoelectric lamina due to an applied voltage. Depending upon the power source and use, the connection of the power source to the lamina, and the way the device or element is used, may vary.

While the present invention will be described broadly, a specific example as applied to a telephone line will be described in detail. In the specific example, for a line status device, a piezoeceramic bender element is connected to the pair of conductors of a telephone line and means provided to obtain a signal indicative of bending of the element on application of a voltage.

Particularly an element is connected across the tip and ring conductors of a telephone line whereby when a telephone set connected to the line goes "off-hook" the voltage change occurring across the tip and ring conductors actuates the element. Bend of the element is used to give an indication, such as closing contacts to actuate an indicator or by causing an appearance at an aperture.

The invention will be readily understood by the following description of certain embodiments, by way of example, in conjunction with the accompanying drawings, in which.

Figure 1:
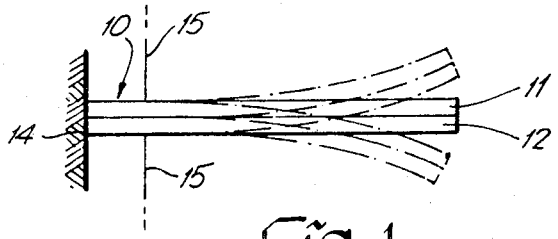
FIG. 1 illustrates diagrammatically the basic feature of the invention.

Considering the basic arrangement as illustrated in FIG. 1, a piezoceramic bending device is indicated generally at 10. The element comprises two layers or elements of piezoceramic material 11 and 12, the layers polarized in opposite directions. The layers 11 and 12 are bonded together and cantilevered at one end 14. The application of an electric field, as by conductors 15, across the two layers or elements causes one layer to expand and the other to contract. The net result is a bending displacement considerably greater than the length variation of either layer.

Thus, if a DC pulse is applied via conductors 15, the elements will bend one way or the other, depending upon the polarity of the pulse, and then return to a neutral position. With a steady DC state, a fairly sudden change in the DC value will cause a quick "pulsing" of the elements depending upon polarity of the initial DC state and the direction of change, i.e. increase or decrease in voltage.

For AC power, the elements will vibrate either side of the neutral position, the amount of displacement depending upon the voltage. A variation in the AC voltage will result in increased or decreased displacement. The bending radius, or displacement is a continuous function of the applied voltage. The device is voltage sensitive and no power is consumed.

The present invention uses a structure, basically as in FIG. 1, to detect or sense, a change in voltage, and give or result in a signal indicative of such a change. It is possible to arrange for the device to give a signal, when a change exceeds a minimum value.

Figure 2:
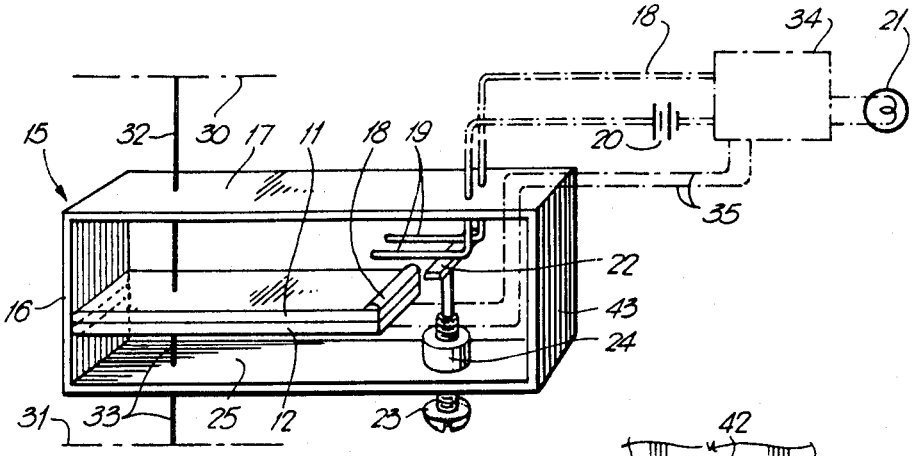
FIG. 2 is a perspective view of an embodiment of the invention with the element in the inactive or non-actuated condition.
Figure 3:
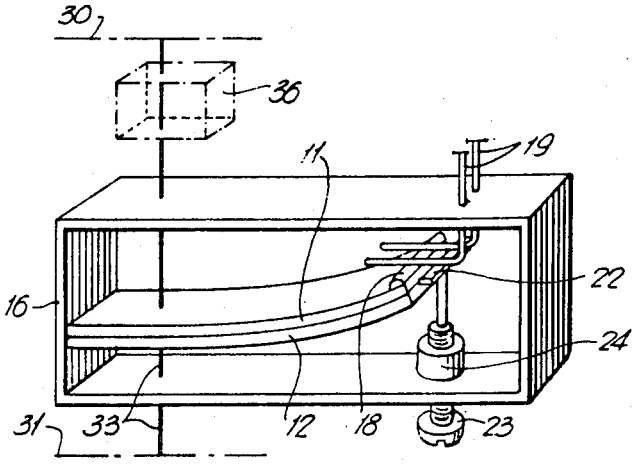
FIG. 3 is a similar view to that of FIG. 2 illustrating the element in an active or actuated condition.

The specific example illustrated in FIGS. 2 and 3 is intended for detecting voltage changes in a telephone line, and providing an indication that a change has occurred.

In the apparatus as illustrated in FIG. 1, the piezoceramic bending device is cantilevered from one end on the end wall 16 of a housing 17. On the free end of the top layer 11 is formed a contact strip 18. Extending through the top wall 17 of the housing are two electrical conductors 19. The ends of the conductors 19 overlie the contact strip 18. In the example, the two conductors 19 have in series a source of power, represented by a battery 20 and an indicator lamp 21.

The position of the ends of the conductors can be prepositioned at assembly and have a set, predetermined spatial relationship to the contact strip 18. Alternatively, as illustrated in FIG. 2, the ends of the conductors are attached to an insulating member 22 which is adjustable by means of a threaded screw 23 passing through a threaded boss 24 on the lower wall 25 of the housing. By rotation of the screw 23 the position of the ends of the conductors 19 can be raised or lowered relative to the contact strip 16. By this means the apparatus can be preprogrammed to require a predetermined voltage for actuation or can be adjusted to suit different voltage conditions.

In the example, the device 10 is parallel across the tip and ring conductors, indicated by chain dotted lines 30 and 31, by conductors 32 and 33 connected to the layers 11 and 12 respectively. On occurrence of a voltage drop between the conductors 30 and 31 a voltage is applied across the device. This causes one layer or element to expand and the other to contract, producing a bending of the device, the bending displacement being considerably greater than the length deformation of either of the two layers. This bending is illustrated in FIG. 2 where the contact strip 18 is now in contact with the ends of the conductors 19, electrically connecting them. This would cause the indicator lamp 21 to be lighted.

It will be appreciated that the two elements 11 and 12, are electrically insulating, and that therefore they form a capacitor. When a DC voltage of one polarity is applied across a device, then there will be an initial deflection of the elements, as shown in FIG. 1, but this deflection will slowly disappear as the "capacitor" charges, until a steady state occurs at the particular voltage. However, when a voltage change occurs, relatively rapidly, there will be an initial deflection of the elements, which then slowly decays. For use in a telephone status indicator, this would result in only a momentary indication. Therefore it is necessary to provide a latching device if a permanent indication is required. An electrical or electronic latching device is indicated in dotted outline at 34 in FIG. 2. The device 34 receives power from the battery 20, and on initial actuation of the elements 11 and 12 contacting conductor strip 18, the latching device is actuated and the lamp 21 is lighted and remains so even after the elements return to their neutral position. The device 34 can be deactivated, or switch off by an input from two further conductors 35 having ends positioned under the free ends of the elements 11 and 12 in a manner similar to conductors 19 but on the opposite side relative to conductors 19. The ends of conductors 35 are contacted by the elements 11 and 12 when they deflect downwards, in FIG. 1 when a DC voltage of another polarity is applied. Such different polarities occur for example, when a telephone set goes off hook causing a voltage reduction between tip and ring lines, giving one polarity, and when a telephone set goes on hook causing a voltage rise between tip and ring and giving the alternative polarity.

FIG. 3 illustrates the situation at the time the telephone goes off hook.

Alternatively, with an AC voltage, the elements will vibrate either side of neutral. This will give a pulsed output, which, if the frequency is high enough, will effectively give a constant light indication, insofar as the human eye is concerned. It is readily possible to insert a converter, which can be solid state, between one of the conductors 30 and 31 and the device. Such a converter is indicated at 36 in FIG. 3. In such an arrangement the device 10 will vibrate, similar to the dotted outline shown in FIG. 1, making contact with the conductors 19 once on each vibration.

A further method would be to provide some means for obviating the capacitor effect resulting from application of DC voltage across the device.

The device is sensitive to changes in voltage. Thus it can be used in systems where the voltage drop across the conductors 30 and 31 is normally zero and rises to a particular value when some action occurs, or vice versa, such as a telephone going off-hook. The device can also be used in systems where there is for example, normally, some voltage at a predetermined value, the voltage rising as a result of some effect or action, or alternatively a voltage decrease occurring as a result such rise or fall in voltage actuating the device. The device is very suitable for telephone lines in that it can be adjusted to accommodate the various voltages which can occur in different conditions, for example in local and domestic installations where the line voltage is generally 48 volts, in PBX installations where the line voltage is 24 volts and on extended loops where the voltage may be as low as 6 volts. It is these varying voltage conditions which can cause problems with other forms of apparatus.

While the device is shown in a housing 15, in FIGS. 2 and 3, which can be completely closed, the device can be in an open environment, provided a support member is available to carry the cantilevered device 10 and some means of positioning the ends of the conductors 18 and 19 is provided. While the indicator lamp 21 is shown as being high powered from a separate source, it is possible to line power the lamp if desired.

Figure 4:
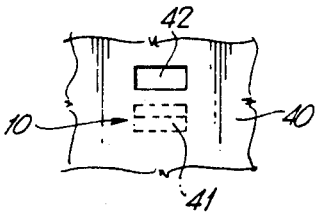
FIG. 4 is a view of part of a housing illustrating an alternative, or additional feature.

FIG. 4 illustrates, very diagrammatically an arrangement in which the bending of the device 10 can be used to give a direct visual indicator. Part of a housing, such as a telephone housing, is indicated at 40, the device being viewed end on and indicated by the dotted outline 41 at its inactive or unactuated position. An aperture 42 is formed in the housing 40 spaced such that when the device 10 bends, its end surface will be visible through the aperture 42. The end of the device can be coloured so as to make it more readily visible through the aperture. The arrangement as illustrated in FIGS. 2 and 3 could readily be modified to give such a visual indication, by omitting the conductors 19, member 22 and screw 23. Contact strip 18 would not be required and the end wall 43 of the housing 15 would be positioned adjacent to the ends of the element 10.

Other arrangements can readily be envisaged. For example, instead of the element moving into contact withe conductors, as in FIGS. 2 and 3, the element can be caused to move an indicator and it can be arranged that movement of the indicator occurs only with a predetermined movement or deformation of the element. This can be used, as with the member 22 and screw 23, to accommodate different voltage conditions.

It is an advantage, for programming the element, that the bending radius of the element is a continuous function of the applied voltage.

The material of the layers 11 and 12 is a piezoceramic, sold by Gulton Industries Inc., of New Jersey, Piezo Products division. The material is a ceramic having piezo electric properties and having the capability of being polarized in a predetermined direction.

A device in accordance with the invention is a solid state device and has the reliability small size, and compactness of such devices. It has very good electrical isolation with very low leakage, a distinct advantage when used across a telephone line. The actuation of the device is accurately predicted and can be made to handle a wide range of voltage and current. Thus voltage in the ranges of 10 to 100 are readily obtained, in the milliwatt range. The device is an electrical equivalent of a magnetic relay and can replace such relays. Switching speeds equal to or greater than that of the conventional magnetic relay can be obtained.

What is claimed is:

1. A piezoelectric operated indicator device for use in telephone status line indicators, said device comprising:

a piezoelectric device having two piezoelectric elements bonded together, said elements being oppositely polarized and being connected as a single member which is cantilever mounted at one end and has an opposite free end;

means for applying an electrical voltage across said two elements, said two elements being in electrical series whereby said piezoelectric device bends from an unbent position in a first or a second direction when a voltage of a first or a second polarity, respectively, is applied; and means responsive to the bending of said piezoelectric device for producing a visual indication of said bending whereby said visual indication producing means provides an indication of a voltage of a predetermined polarity being applied across said series connected elements, said visual indication producing means comprising a wall having an opening formed therein, said opening being positioned such that a portion of said piezoelectric device is visible in said opening when said piezoelectric device is in one of the bent and unbent positions, and said portion of said piezoelectric device is not visible in said opening when said piezoelectric device is in another of said bent or unbent positions.

2. A piezoelectric operated indicator device for use in telephone status line indicators, said device comprising:

a piezoelectric device having two piezoelectric elements bonded together, said elements being oppositely polarized;

means for applying an electrical voltage across said two elements, said two elements being in electrical series whereby said piezoelectric device bends from an unbent position in a first or a second direction when a voltage of a first or a second polarity, respectively, is applied; and means responsive to the bending of said piezoelectric device for producing a visual indication of said bending whereby said visual indication producing means provides an indication of a voltage of a predetermined polarity being applied across said series connected elements, said visual indication producing means comprising an electric light, a power source for said electric light, a pair of electrical contacts positioned to be actuated by said piezoelectric device when said piezoelectric device bends to a first position in response to a voltage of a predetermined polarity, and latch means for continuously connecting said power source to said electric light in response to a momentary actuation of said contacts, and wherein said indicator device further includes a second set of electrical contacts positioned to be actuated by said piezoelectric device when said piezoelectric device is in a second position, and wherein said latch means is responsive to said second set of contacts to disconnect said power source from said electric light when said second contacts are momentarily actuated.

3. The indicator device as set forth in claim 1 wherein said wall and said portion of said piezoelectric device have contrasting colors.

4. The indicator device as set forth in claim 1 or 3 wherein said portion of said piezoelectric device is said free end.

* * * * *